US006883286B2

(12) United States Patent
Wright, Jr.

(10) Patent No.: US 6,883,286 B2
(45) Date of Patent: Apr. 26, 2005

(54) FLOORING DISPLAY PANEL WITH DURABLE LABEL

(75) Inventor: William Donald Wright, Jr., Dalton, GA (US)

(73) Assignee: Wright of Thomasville, Inc., Thomasville, NC (US)

( * ) Notice: Subject to any disclaimer, the term of this patent is extended or adjusted under 35 U.S.C. 154(b) by 201 days.

(21) Appl. No.: 10/291,465

(22) Filed: Nov. 8, 2002

(65) Prior Publication Data

US 2005/0016096 A1 Jan. 27, 2005

(51) Int. Cl.[7] ..... E04F 13/00; E04F 15/00; E04F 19/00

(52) U.S. Cl. ..... 52/311.1; 52/315; 52/105; 52/515

(58) Field of Search ..... 52/105, 311.1, 52/315, 515; 428/40.1, 41.7, 41.8, 42.1, 343, 352, 354; 283/56, 81, 107; 40/360, 638, 675, 616

(56) References Cited

U.S. PATENT DOCUMENTS

| | | | | | |
|---|---|---|---|---|---|
| 4,565,290 | A | * | 1/1986 | Corrigan et al. | 211/41.1 |
| 4,763,930 | A | | 8/1988 | Matney | 283/81 |
| 4,915,994 | A | | 4/1990 | Begelfer et al. | 428/40 |
| 4,948,450 | A | | 8/1990 | Hürter et al. | 156/310 |
| 5,085,906 | A | | 2/1992 | Ast et al. | 428/36.92 |
| 5,227,233 | A | | 7/1993 | Itaba et al. | 428/354 |
| 5,328,738 | A | * | 7/1994 | McKillip et al. | 428/40.9 |
| 5,747,192 | A | | 5/1998 | Hughen et al. | 429/163 |
| 5,773,112 | A | * | 6/1998 | Tachikawa et al. | 428/40.1 |
| 5,820,957 | A | * | 10/1998 | Schroeder et al. | 428/40.1 |
| 6,017,408 | A | | 1/2000 | Rogers et al. | 156/249 |
| 6,170,674 | B1 | * | 1/2001 | Caterinacci | 211/41.1 |
| 6,248,427 | B1 | | 6/2001 | Ast | 428/203 |
| 6,270,871 | B1 | | 8/2001 | Scholz et al. | 428/40.1 |
| 6,358,588 | B1 | * | 3/2002 | Edwards et al. | 428/42.2 |
| 6,541,091 | B1 | * | 4/2003 | Washburn et al. | 428/40.1 |
| 6,562,451 | B1 | * | 5/2003 | Syoda et al. | 428/330 |

* cited by examiner

*Primary Examiner*—Carl D. Friedman
*Assistant Examiner*—Chi Q. Nguyen
(74) *Attorney, Agent, or Firm*—Womble Carlyle Sandridge & Rice, PLLC; C. Robert Rhodes

(57) ABSTRACT

A flooring display sample is disclosed having a durable and attractive information label attached thereon. The flooring display sample includes a panel comprising at least one flooring material and having an outer face. A label is adhered to the outer face of the display panel. The label includes a substantially transparent polymeric film having a front face and a back face. Indicia are reverse printed on the back face of the substantially transparent polymeric film. A backing film is adhered on the back face of the substantially transparent polymeric film and the printed indicia thereon. The reverse-printed indicia are visible through the front face of the substantially transparent polymeric film. The label may further include a protective coating on the back face of the substantially transparent polymeric film and the printed indicia thereon, and the backing film may substantially cover the protective coating.

14 Claims, 1 Drawing Sheet

FLOORING DISPLAY PANEL WITH DURABLE LABEL

BACKGROUND

1. Field of the Invention

The invention relates to flooring display panels having durable polymeric film labels applied thereto.

2. Description of the Prior Art

In the flooring industry, flooring material samples are used to display various types of flooring materials to potential purchasers. Such flooring material samples typically include rectangular panels comprising flooring materials such as hardwood planks, vinyl sheets or tiles, ceramic tiles, and the like. Because flooring products are produced in a wide variety of styles, materials, colors, and finishes, it is important that purchasers be able to ascertain how a particular flooring product will look when assembled on a floor surface. Flooring display panels are often used to present accurate representations of these flooring materials to prospective buyers. Therefore, it is common for flooring product manufacturers, distributors, retailers, and the like to have a large number of such panels on hand that represent a variety of flooring products available for inspection. Such panels may be arranged in racks or display fixtures. It is desirable to have detailed information relating to a particular flooring product permanently and attractively attached to the panel for use by a seller or buyer. Accordingly, informational and promotional labels are often directly adhered to portions of the surfaces of these flooring display panels.

Printed labels are known for associating printed information with such flooring samples. These labels are pre-printed with information that identifies or describes their associated flooring materials, and are attached to these objects by various types of permanent or semi-permanent connections. The information on these labels may include printed text, images, or a combination of printed text and images. The text and or images may be printed in black and white or in color, and may be printed using one or more known printing methods. Such labels typically include printed paper, paperboard, or cardboard substrates (hereinafter collectively referred to as "paper"). In order to make these printed paper labels somewhat moisture and wear resistant and therefore more durable than plain paper labels, the outer printed surfaces of such labels may be coated with a moisture-resistant and wear-resistant transparent coating after printing. Alternatively, a thin transparent or translucent plastic laminate may be adhered to the printed surface with a substantially transparent adhesive to provide a protective surface on the label. The transparent laminate film may extend past the edges of the overlaid paper label such that the edges of the laminate film may be directly adhered to the flooring sample, thereby affixing the label to the display panel.

Often it is desirable that identification or informational labels of this type remain permanently attached to the flooring samples for extended periods. It is not uncommon for such flooring display panels to be subjected to repeated handling and other harsh treatment. Such handling often damages or mars conventional printed paper labels. For example, paper labels laminated on their outer faces with a transparent or translucent plastic film are commonly used to label flooring panels. As a result of the repeated handling of these panels, it is common for the plastic laminate films to at least partially delaminate from the flooring panels and the underlying paper label. Furthermore, because the printed information is typically printed on a paper label before the paper label is laminated with the transparent plastic film, this delamination can at least partially destroy or obscure at least a portion of the printed information on the label, thereby detracting from the overall appearance of the hardwood flooring panel.

Accordingly, there is a need for flooring display panels to include a more durable and attractive label that is more resistant to degradation than conventional laminated paper labels.

SUMMARY OF THE INVENTION

A flooring sample containing an attractive and durable label is disclosed. The label is more resistant to disfigurement caused by wear and/or delamination than conventional printed paper layers with plastic laminates adhered over their printed paper surfaces. The label includes a substantially transparent polymeric film having a front face and a back face. The film may be a polyvinyl chloride, for example. Indicia is reverse-printed on the back face of the substantially transparent polymeric film. The indicia may include printed text, printed images, or any combination thereof. The indicia may be printed on the back surface of the substantially transparent polymeric film by offset printing or any other suitable printing method. A protective coating is preferably provided on the back face of the substantially transparent polymeric film and over the printed indicia thereon. The protective coating is at least partially visible through the front face of the substantially transparent polymeric film around and between the printed indicia. A backing film is adhered on the back face of the substantially transparent polymeric film and the printed indicia and protective coating thereon. The backing film may be synthetic paper, paper, white polyethylene film, or the like.

The protective coating is preferably substantially opaque, but can be clear. Alternatively, the protective coating may be at least partially translucent such that the backing film is at least partially visible through the substantially transparent polymeric film and the protective coating around and between the printed indicia. Preferably, the protective coating and backing film are substantially white in color. Other colors of protective coatings and backing films may be used, however, as desired. In order to provide the label with an anti-glare outer surface, the front face of the substantially transparent polymeric film may include a matte finish.

The label is applied to a flooring display sample. The display sample includes a flooring material such as a plurality of hardwood flooring planks, a section of vinyl flooring, a plurality of ceramic tiles, or the like. A label as summarized above is adhered to an outer face of the display panel with a suitable adhesive. The label be adhered to a front or rear face of the flooring display sample. The label includes a substantially transparent polymeric film having a front face and a back face, indicia reverse-printed on the back face of the substantially transparent polymeric film, a protective coating substantially covering the back face of the substantially transparent polymeric film and the printed indicia thereon, and a backing film adhered on the back face of the substantially transparent polymeric film that substantially covers the printed indicia and protective coating thereon. The printed indicia and at least a portion of the protective coating are visible through the front face of the substantially transparent polymeric film, and include text and/or images that describe the associated flooring materials.

Unlike conventional laminated printed paper labels, the label construction is resistant to separation of the printed indicia from the transparent polymeric film. Because the printed indicia are reverse-printed directly on the back face of the transparent polymeric film, even if the backing film becomes at least partially delaminated from the transparent film, the appearance of the printed indicia through the front face of the transparent film remains substantially unaltered. Accordingly, the label typically lasts up to four times longer than conventional laminated paper labels when used on flooring display panels.

The invention will be more thoroughly understood from a reading of the following detailed description together with the drawings.

DETAILED DESCRIPTION

Figure 1:
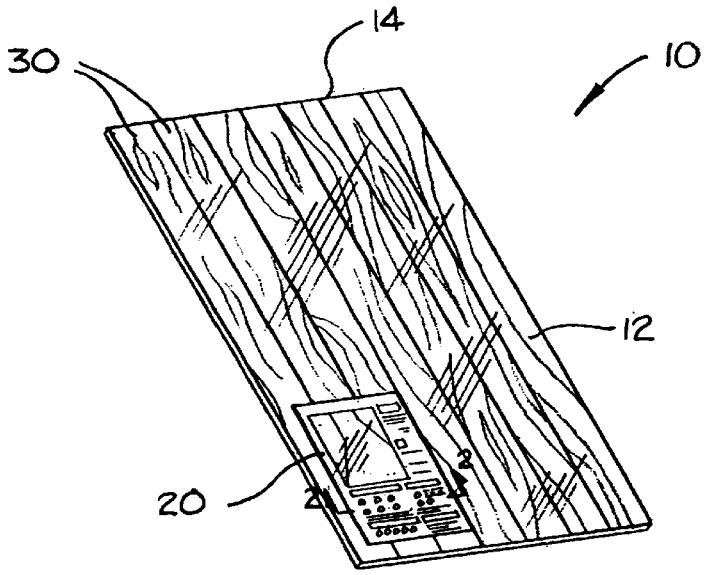
FIG. 1 is a perspective view of a hardwood flooring display panel with a label adhered thereto.

FIG. 1 shows a flooring material display sample 10 and label 20 adhered to an outer surface 12 of a flooring panel 14. The sample 10 includes a panel 14 comprising a flooring material 30 such as hardwood planks, a section of vinyl flooring, ceramic tiles, or the like. The sample 10 is sufficiently large to accurately represent a portion of a floor constructed of the flooring material 30. The label 20 is adhered to an outer surface 12 of the panel 14 with a suitable adhesive 80. Preferably, the adhesive is selected so that the label 20 is substantially permanently attached to the panel 14. The label 20 may be affixed to either a front or rear face of the panel 14.

Figure 2:
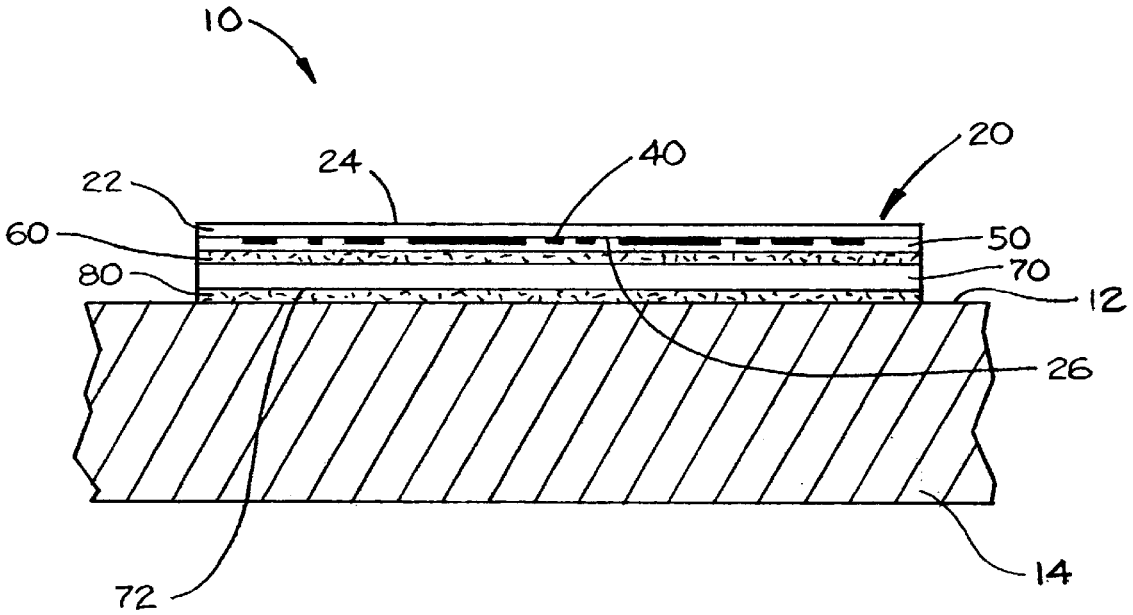
FIG. 2 is a cross-sectional view of the hardwood flooring display panel and label adhered thereto as taken along line 2—2 in FIG. 1.

FIG. 2 shows a partial cross-section of the flooring sample 10 and the label 20 adhered to an outer surface 12 of the panel 14. It is noted that the various indicated thicknesses of the component layers of the label 20 and sample 10 are drawn to illustrate the construction of the label 20 and are not intended to represent actual or relative thicknesses of the label components.

As shown in FIG. 2, the label 20 includes a substantially transparent polymeric film 22 having an front face 24 and a back face 26. The transparent film 22 is preferably polymeric, and may be constructed of polyvinyl chloride (PVC), polycarbonate, polyethylene, or the like. The transparent film 22 may be constructed of any substantially transparent film material that is capable of receiving the printed indicia 40 and protective coating 50 on its back face 26 as described more fully below. The film 22 preferably is sufficiently thick that it resists curling in a free state. For example, the film 22 may have a thickness of at least about 0.005 inch and preferably about 0.010 inch. In a preferred embodiment, the front face 24 of the transparent film 20 includes a matte finish that is resistant to glare. Printed indicia 40 are reverse-printed directly on the back face 26 of the transparent film 22. The printed indicia 40 may include text, images, or any combination thereof, and may be printed by any suitable printing method. The ink preferably is an oil base offset, UV offset, or hybrid UV offset ink available from Monarch Color Corp. The printed indicia 40 may be printed with conventional offset printing methods and equipment, for example.

As also shown in FIG. 2, a protective coating 50 is applied over the back face 26 of the transparent film 22 and printed indicia 40 thereon. The coating 50 may be an aqueous protective coating available from Cork Industries of Folcroft, Pa. While the coating 50 is preferred, it may be omitted as it is substantially for the purpose of providing a smoother and more even appearance to the label 20. The protective coating 50 may be applied by any suitable printing or coating method; is substantially opaque or is at most partially translucent; is at least partially visible through the front face of the transparent film 22 and around the printed indicia 40; and provides a contrasting background for the printed indicia 40. Preferably, the protective coating 50 is substantially white in color.

A backing film 70 is adhered to the transparent film 22, printed indicia 40, and protective coating 50 thereon with a pressure sensitive adhesive layer 60. When the protective coating 50 is at least partially translucent or is omitted altogether, the adhesive 60 is preferably substantially transparent so that the backing film 70 is at least partially visible through the transparent film 20, the protective coating 50 (if present), and the adhesive 60. Preferably, the protective coating 50 and backing film 70 have substantially the same color. For example, the protective coating 50 and backing film 70 may both be substantially white. The adhesive layer 60 may include any suitable adhesive that is non-yellowing and that does not harmfully react with the inks used to print the indicia 40 or with the protective coating 50.

The label 20 is adhered to an outer surface 12 of a flooring material display sample 10 with a suitable wet adhesive 80 and is allowed to dry. Preferably, the adhesive 80 is a permanent adhesive.

In use, the label 20 is highly durable and mar-resistant. Because the printed indicia 40 and protective coating 50 are substantially permanently affixed to the back face 26 of the transparent film 22, even if the backing film 70 becomes partially separated from the other portions of the label, such as around or at the edges, the outward appearance of the label 20 from the front face 24 of the label 20 remains substantially unaltered. Thus, the label 20 provides an attractive informational label on flooring display panels that is more permanent and durable than conventional laminated paper labels.

What is claimed is:

1. A flooring display sample comprising:

(a) a display panel comprising at least one flooring material, the panel having an outer face;

(b) a label adhered to the outer face of the display panel, the label comprising:

(i) a substantially transparent polymeric film having a front face and a back face;

(ii) indicia reverse printed on the back face of the substantially transparent polymeric film;

(iii) a protective coating on the back face of the substantially transparent polymeric film and the printed indicia thereon; and (iii) a backing film adhered on the back face of the substantially transparent polymeric film that substantially covers the printed indicia thereon and also substantially covers the protective coating;

(c) wherein the printed indicia are visible through the front face of the substantially transparent polymeric film.

2. A flooring display sample according to claim 1 wherein the protective coating is at least partially translucent, and the backing film is at least partially visible through the front face of the substantially transparent polymeric film and through the partially translucent protective coating.

3. A flooring display sample according to claim 2 wherein the substantially transparent polymeric film is at least 0.005 inch thick.

4. A according to claim 2 wherein the substantially transparent polymeric film is polyvinyl chloride.

5. A flooring display sample according to claim 2 wherein the substantially transparent polymeric film is polycarbonate.

6. A flooring display sample according to claim 2 wherein the substantially transparent polymeric film is polyethylene.

7. A flooring display sample according to claim 2 wherein the printed indicia is reverse printed on the back face of the substantially transparent polymeric film by offset printing.

8. A flooring display sample according to claim 2 wherein the protective coating is substantially white in color.

9. A flooring display sample comprising:

(a) a display panel comprising at least one flooring material, the panel having an outer face;

(b) a label adhered to the outer face of the display panel, the label comprising:

(i) a substantially transparent polymeric film having a front face and a back face;

(ii) indicia reverse printed on the back face of the substantially transparent polymeric film;

(iii) a backing film adhered on the back face of the substantially transparent polymeric film that substantially covers the printed indicia thereon, wherein the backing film comprises synthetic paper;

(c) wherein the printed indicia are visible through the front face of the substantially transparent polymeric film.

10. A flooring display sample according to claim 9 wherein the backing film is substantially white in color.

11. A flooring display sample according to claim 9 wherein the printed indicia includes printed text and at least one printed image.

12. A flooring display sample according to claim 9 wherein the front face of the substantially transparent polymeric film has an anti-glare finish.

13. A flooring display sample according to claim 9 wherein the printed indicia is at least partially printed with oil base offset ink.

14. A flooring display sample according to claim 9 wherein the printed indicia is at least partially printed with UV offset ink.

* * * * *